United States Patent [19]

Giolitti et al.

[11] 4,077,505

[45] Mar. 7, 1978

[54] PRINTING DEVICE FOR CALCULATING, ACCOUNTING AND SIMILAR PRINTING MACHINES

[75] Inventors: Nicolò Giolitti, Ivrea (Turin); Michele Bovio, Banchette (Turin), both of Italy

[73] Assignee: Ing. C. Olivetti & C., S.p.A., Ivrea (Turin), Italy

[21] Appl. No.: 698,923

[22] Filed: Jun. 23, 1976

[30] Foreign Application Priority Data

Jun. 26, 1975 Italy ..... 68643/75

[51] Int. Cl.[2] ..... B41J 3/04

[52] U.S. Cl. ..... 197/1 R; 101/93.04; 101/93.34

[58] Field of Search ..... 197/1 R, 6.7, 6.6; 101/93.04, 93.05, 93.28, 93.34, 93.29, 93.30, 93.33; 335/278, 285, 289

[56] References Cited

U.S. PATENT DOCUMENTS

| | | | |
|---|---|---|---|
| 3,236,352 | 2/1966 | Schacht | 197/6.6 |
| 3,672,482 | 6/1972 | Brumbaugh et al. | 197/1 R |
| 3,707,122 | 12/1972 | Cargill | 101/93 C |
| 3,834,305 | 9/1974 | Gomi | 101/93 C |
| 3,837,460 | 9/1974 | Chida et al. | 197/1 R |
| 3,891,077 | 6/1975 | Sauerbrunn | 197/1 R |
| 3,967,714 | 7/1976 | Potma et al. | 197/1 R |
| 3,977,509 | 8/1976 | Leersnijder | 197/1 R |

*Primary Examiner*—Ralph T. Rader

*Attorney, Agent, or Firm*—Schuyler, Birch, Swindler, McKie & Beckett

[57] ABSTRACT

A dot-matrix printing device for a printing office machine, comprising a series of striking bars in the proximity of the recording medium movable transversely of the medium for printing dots in different locations. The bars are adapted to be actuated by the armatures of corresponding electromagnets for impressing individual dots of characters. The striking bars are guided in the proximity of the recording medium by a movable guide which effects the transverse movement and each electromagnet has a fixed core and a movable armature in articulated engagement with the corresponding bar. Each armature is provided with an actuating spring which tends to move the armature away from the core of the electromagnet. A permanently magnetized rubber establishes a bias magnetic flux such as to keep the armatures at rest in opposition to the action of the actuating springs and a plurality of windings can be energized selectively to generate a flux opposed to the bias flux so as to allow the actuating springs to move the armatures away from the cores for impression of the dots. The device further includes a reloading member which acts on the armatures to bring them back into contact with the cores of the electromagnets.

26 Claims, 14 Drawing Figures

FIG. 7
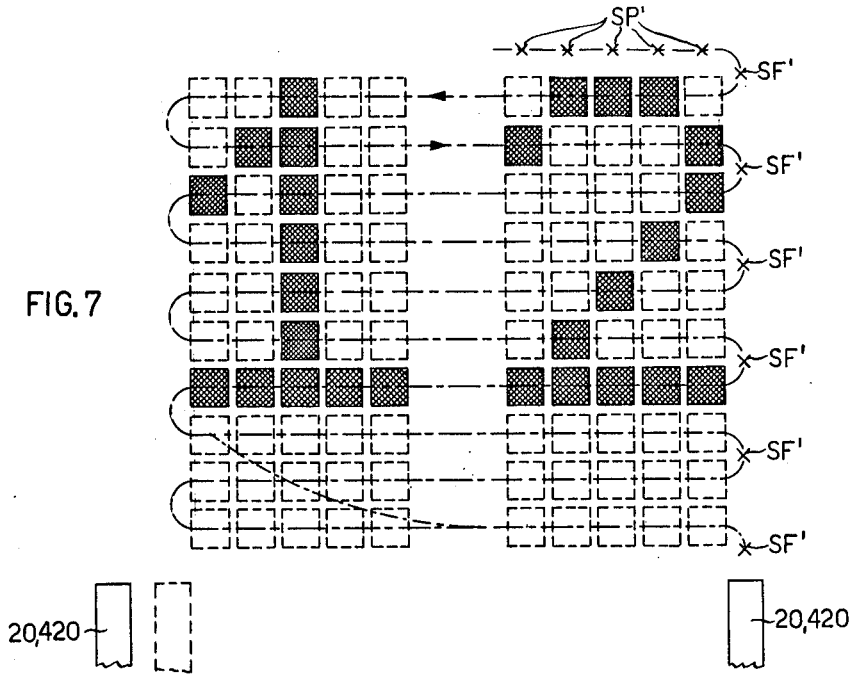
FIG. 5
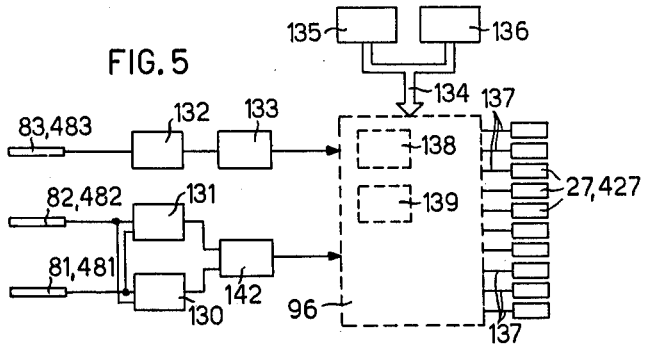
FIG. 6
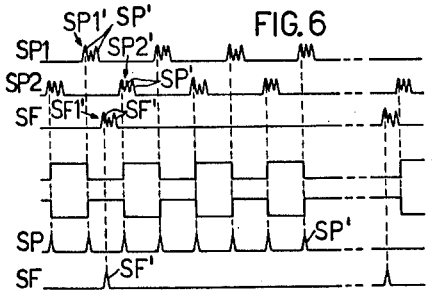
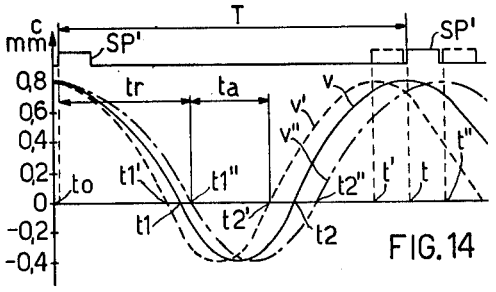
FIG. 14

PRINTING DEVICE FOR CALCULATING, ACCOUNTING AND SIMILAR PRINTING MACHINES

BACKGROUND OF THE INVENTION

1. Field of the Invention

The present invention relates to a dot-matrix printing device for calculating and accounting machines, typewriters and other printing office machines, wherein a series of striking elements in the proximity of the recording medium are movable transversely with respect to the medium and are adapted to be actuated by the armatures of corresponding electromagnets for impressing the individual dots of each character.

2. Description of the Prior Art

A series-parallel dot-matrix printing device is known wherein electromagnets actuating striking elements in the form of flexible wires have their cores fixed to the frame of the machine and their armatures have fixed to them the corresponding flexible wires, which are guided in the proximity of the recording medium by corresponding guide tubes fixed to a slide which is aligned with respect to the printing line. The slide is moved with a reciprocating motion parallel to the printing line so as to allow the ends of the wires to shift along the rows of the character matrix. The electromagnets are actuated selectively for printing the dots disposed in the rows of the matrix. In order to limit the lateral stresses exerted on the armatures of the electromagnets and on the guide tubes and to permit a sufficient and uniform action at the printing ends of the wires, the wires themselves are relatively long and are arched along a wide radius of curvature in order to accommodate the movements of the slide relative to the electromagnets. A device of this type becomes complex, bulky and costly because of the further need to connect the printing wires, which have high hardness and flexibility characteristics, individually to the armatures, of which high magnetic characteristics are required.

A series-parallel dot-matrix printing device is also known wherein the printing elements are constituted by styluses which are relatively short and rigid and fixed to cylindrical armatures of corresponding electromagnets of the hollow-core, solenoid type. The guides of the styluses and the electromagnets are fixed to a carriage shifted with a reciprocating motion parallel to the platen. This device requires a carriage and a corresponding guide structure which are rather heavy and bulky because of the need to absorb the reaction of all the armatures when printing takes place. The driving mechanism of the carriage itself has to be rather strong and therefore bulky and costly.

There is likewise known a series-parallel dot-matrix printing device wherein the striking elements are constituted by projections aligned with the printing line and formed at the ends of corresponding leaf springs in such manner as to form a comb. The springs are fixed on a carriage and are moved with a reciprocating motion parallel to the line so that each projection may print all the dots of a row of the matrix of a corresponding character. The end of each spring is adjacent the core of an electromagnet so as to be selectively attracted by the core itself and be released to print the corresponding dot, using the energy stored in the spring. A device of this type has the disadvantage of requiring electromagnets of relatively large dimensions and considerable energy for activating the electromagnets, which makes this device costly.

A dot printer operating on telegraph tape is known wherein the dots of a row of the character matrix are printed in parallel by corresponding bars connected by means of springs to a frame moved forward and backward by an actuating eccentric in front of the printing point.

Each bar can be coupled selectively to the armature of an electromagnet to be left inoperative or to be actuated for printing by the actuating eccentric. A device of this type is very complex and costly and, moreover, cannot be used advantageously in page printers because of the high construction tolerances required by the arrangement of the bars in parallel.

There is also known a serial printing device having seven flexible printing wires, wherein the free ends are vertically aligned by a resin guide. The other ends are each fixed to corresponding armatures arranged in a semi-circle and normally retained on the pole pieces of a magnetic core by the magnetic field generated by a permanent magnet and in opposition to the action of respective printing springs. The device, including the magnetic circuit, the armatures, the wires and the guides, is borne by a carriage movable transversely of the printing line. In the proximity of each armature there is moreover prearranged in the magnetic circuit a winding which, when it is energised, creates a magnetic field opposed to that of the permanent magnet, which allows the striking spring to actuate the wire for printing the dot. In this device, the recovery of the armature must be effected by the magnetic force of the permanent magnet in opposition to the action of the striking spring. The field of the permanent magnet must be fairly intense, the dimensions of the permanent magnet therefore become considerable and the energy required for printing the dot, although lower than in printing with positive actuation of the wire, is nevertheless high and requires an electronic control of high power. For these reasons, the device can find application only in those printers in which the problems of cost and size are not important.

There has also been proposed a printing device provided with a series of flexible wires which are also aligned vertically and fixed to corresponding armatures. These armatures, in turn, are retained against the pole pieces of an electromagnet by the magnetic field generated therein by the energising current of the electromagnets themselves and in opposition to the action of striking springs. By de-energising each electromagnet, the striking spring actuates the wire for printing the dot and a common cam brings the armature back into contact with the pole pieces of the electromagnet. In this device, since the electromagnets themselves must create the force necessary for retaining the armatures, with a very limited air gap, a relatively low pulse energy is required, but, since the styluses are generally in the inoperative position, the windings of the electromagnets are constantly traversed by the energising current. The dimensions of the electromagnets are therefore large and necessitate a relatively high average energising energy which requires a rather costly supply.

SUMMARY OF THE INVENTION

The object of the present invention is to provide a simple and economic series-parallel dot printing device of small dimensions wherein the inertias of the moving parts are reduced to the maximum degree and which requires very limited consumption of energy.

According to the present invention there is provided a dot-matrix printing device for a printing office machine, wherein a series of striking elements in the proximity of the recording medium are movable transversely of the medium for printing dots in different locations and are adapted to be actuated by the armatures of corresponding electromagnets for impressing individual dots of characters, the striking elements being substantially rigid bars guided in the proximity of the recording medium by a movable guide which effects the transverse movement and each electromagnet having a fixed core and a movable armature in articulated engagement with the corresponding bar.

The invention makes it possible to reduce to the minimum the dimensions of the striking elements and the inertias of the masses having a reciprocating motion, which are limited here to the guides of the ends of the bars, and it has been possible to optimise the magnetic circuit, both from the point of view of dimensions and of efficiency and simplicity of construction.

Another object of the invention is to provide a dot printing device having low pulse energy consumption, like those devices which utilise electromagnets subject to control for actuating the printing elements, and with a low average-energy consumption, as in those devices in which the retention of the wires is achieved by the force of a permanent magnetic field.

There is therefore provided a device in accordance with the invention, wherein each armature is provided with an actuating spring which tends to move the armature away from the core of the electromagnet, means establishing a bias magnetic flux such as to keep the armature at rest in opposition to the action of the actuating spring and a winding which can be energised selectively to generate a flux opposed to the bias flux so as to allow the actuating spring to move the armature away from the core for impression of a dot, the device including a reloading member which acts on the armatures to bring them back into contact with the cores of the electromagnets.

A further object of the invention is to provide a dot printing machine having low constructive and testing cost, without effecting neither the reliability nor the printing quality.

BRIEF DESCRIPTION OF THE DRAWINGS

The invention will be described in more detail, by way of example, with reference to the accompanying drawings, wherein:

FIG. 5 is a circuit diagram for the control of the printing device;

FIG. 6 is a diagram showing the shape or nature of a number of signals of the circuit of FIG. 5;

FIG. 7 is a diagram illustrating the printing scheme of the device;

FIG. 14 is a diagram showing various operating modes of the printing device.

DETAILED DESCRIPTION OF THE PREFERRED EMBODIMENT

Figure 1:
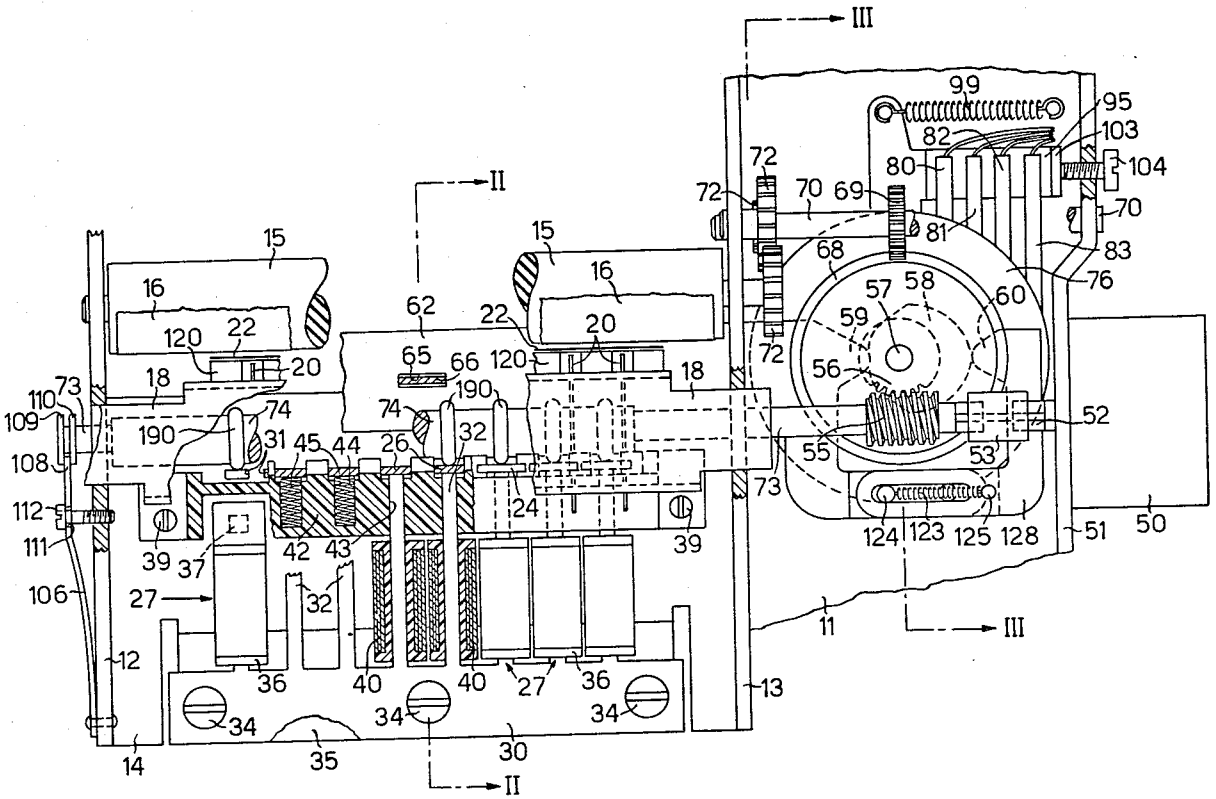
FIG. 1 is a plan view, partly in section, of a printing device embodying the invention.

According to the preferred embodiment of the invention, the printing device includes a frame 11, 411 (FIGS. 1 and 8) constituted by a base plate 14, 414 of ferromagnetic material and two vertical sides 12, 412 and 13, 413 in which a platen 15, 415 supporting a sheet of paper 16, 416 is journalled. In front of the platen 15, 415 there is arranged a horizontal slide 18, 418 which can slide in the sides 12, 412 and 13, 413 parallel to the platen 15, 415.

On the slide 18, 418 there is mounted a series of bars 20, 420 which are parallel to one another and slidable individually in guides 19, 419 (FIGS. 2 and 10) of the slide 18, 418. Each bar 20, 420 has a thickness of 0.3 mm and has one end 21, 421 tapered in the form of a wedge to define a printing tip of substantially square cross-section.

Interposed between the sheet of paper 16, 416 and the bars 20, 420 there is arranged an inked ribbon 22, 422 of known type. On the slide 18, 418 there is mounted a block 120, 520 of plastics material provided with openings 121, 521 in which the printing ends 21, 421 of the bars 20, 420 are accommodated. This block 120, 520 prevents the inked ribbon 22, 422 touching the bars 20, 420 when the latter are not actuated. Moreover, when the inked ribbon is put on, the length of ribbon interposed between the bars and the platen 15, 415 is prevented from being able to foul the said bars 20, 420.

Each bar 20, 420 is provided with a groove 23, 423 in which there is seated the upper end 24, 424 of an armature 26, 426 of a control electromagnet 27, 427.

Each armature 26, 426 is of ferromagnetic material and has its lower end 29, 429 shaped in the form of a fork which is accommodated in the base plate 14, 414. Moreover, each armature 26, 426 co-operates with a corresponding pole piece 32, 432 of the electromagnet 27, 427.

Figure 2:
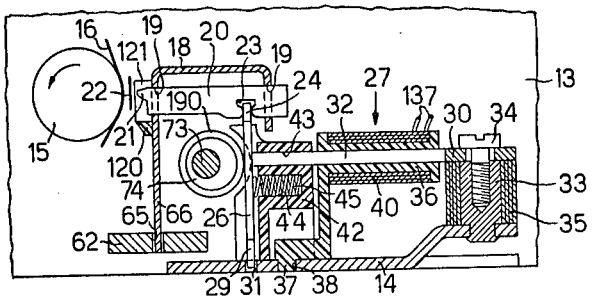
FIG. 2 is a section on the line II-II of FIG. 1.
Figure 10:
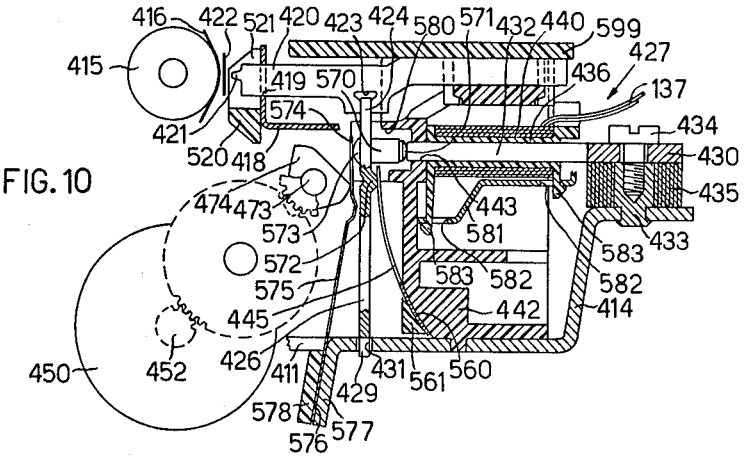
FIG. 10 is a side view from the left, partly in section, of the device of FIG. 8.

The pole pieces 32, 432 are formed as tongues of a single plate 30, 430 (FIGS. 1 and 8) of ferromagnetic material which is connected to the plate 14, 414 through blocks 33, 433 of non-magnetic material and clamping screws 34, 434 (FIGS. 2 and 10).

Between the plate 30, 430 and the plate 14, 414 there is arranged a permanent magnet 35, 435 constituted, for example, by a strip of magnetic rubber. This magnetic rubber is compressed between the said two plates, so that air gaps are avoided, and creates a constant magnetic bias flux between the plate 14, 414 and the pole pieces 32, 432 which keeps the armatures 26, 426 in contact with the pole pieces 32, 432.

Around each pole piece 32, 432 there is arranged a spool 36, 436 of plastics material. Each spool 36 (FIG. 2) is integral with a bracket having a locating peg 37 inserted in a corresponding hole 38 in the base plate 14. On each spool 36, 436 (FIGS. 2 and 10) there is wound the turns of an energising coil 40, 440 through which electric current does not normally flow and which can be energised to cancel out the bias flux in the corresponding pole piece 32, 432.

Between the spools 36, 436 and the armatures 26, 426 there is arranged a single support 42, 442 of plastics material which is fixed by means of screws 39 (shown only in FIG. 1) to the base plate 14, 414 and is provided with through holes 43, 443 for housing the ends of the pole pieces 32, 432. A series of springs 45, 445 tend to urge the armatures 26, 426 towards the platen 15, 415 in opposition to the action of the flux created by the permanent magnet 35, 435. More particularly, in the support 42 (FIGS. 1 and 2), in correspondence with each armature 26, there is formed a cylindrical recess 44 inside which there is arranged one of the springs 45, which is of spiral type and is compressed between the bottom of the recess 44 and the corresponding armature 26. Except when a winding is energised, the action of the bias flux prevails over the action of the spring.

The slide 18, 418 (FIGS. 1 and 8) and the bars 20, 420 are caused to move with a reciprocating motion in front of the platen 15, 415 by shifting means which comprise an electric motor 50, 450, a cam 58, 458 set in rotation by the motor 50, 450, and cam followers 59, 459 and 60, 460 which co-operate with the cam 58, 458 and are connected in turn to the slide 18, 418. The motor 50, 450 rotates a worm 55, 455 in mesh with a corresponding gear 56, 456 mounted rotatably on a vertical spindle 57, 457 of the frame 11, 411. The motor 50 is mounted on a third vertical side member 51 of the frame 11 and has its driving shaft 52 connected through an axially sliding flexible coupling 53 to the worm 55.

On the spindle 57, 457, fast with the gear 56, 456, is mounted the cam 58, 458, with which the cam followers 59, 459 and 60, 460 co-operate. A spiral spring 123, 523 stretched between a point 124, 524 of the cam follower 59, 459 and a point 125, 525 of the cam follower 60, 460 holds the two cam followers 59, 459 and 60, 460 constantly against the edge of the cam 58, 458 in order to take up any possible play due to wear.

The cam follower 59 is carried by a horizontal slider 62 which is guided in the side members 12 and 13 of the frame 11, and the cam follower 60 is carried by a plate 128 which is connected to the slider 62. This slider is provided with a slot 65 (FIGS. 1 and 2) into which a bottom shank 66 of the slide 18 is inserted so as to render the slider 62 and the slide 18 fast with one another.

The cam 58, 458 (FIGS. 1 and 8) is shaped in such manner as to cause the slide 18, 418 to perform an oscillation the amplitude of which is substantially equal to the width of two print characters along a printing line on the sheet of paper 16, 416. More particularly, each bar 20, 420 is adapted to print two characters (FIG. 7) dot by dot in a $7 \times 5$ matrix. The cam 58, 458 which controls the movement of the slide 18, 418 is shaped so that the bars 20, 420 are shifted at substantially constant speed in the spaces in which the characters are to be printed and accelerate and decelerate during the spaces between two characters. Moreover, in order also that the first and last dot of each character row may be equidistant from the other dots, the effective stroke of the bars 20, 420 is greater than the distance between the extreme dots of a row of the matrix.

Furthermore, the width of each upper part 24, 424 (FIGS. 1 and 8) of each armature 26, 426 is substantially equal to the amplitude of the said oscillation, so that each armature 26, 426 always co-operates with the same bar 20, 420 during the movements of the latter in front of the sheet of paper 16, 416.

Figure 3:
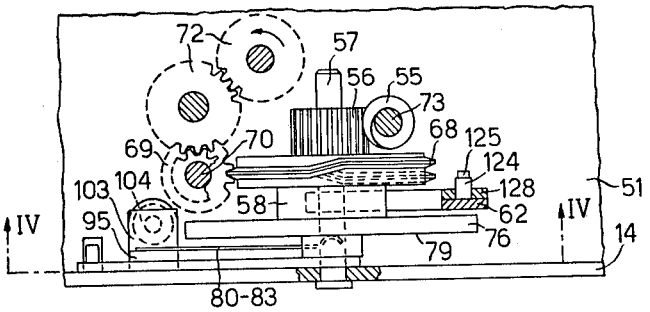
FIG. 3 is a section on the line III—III of FIG. 1.
Figure 8:
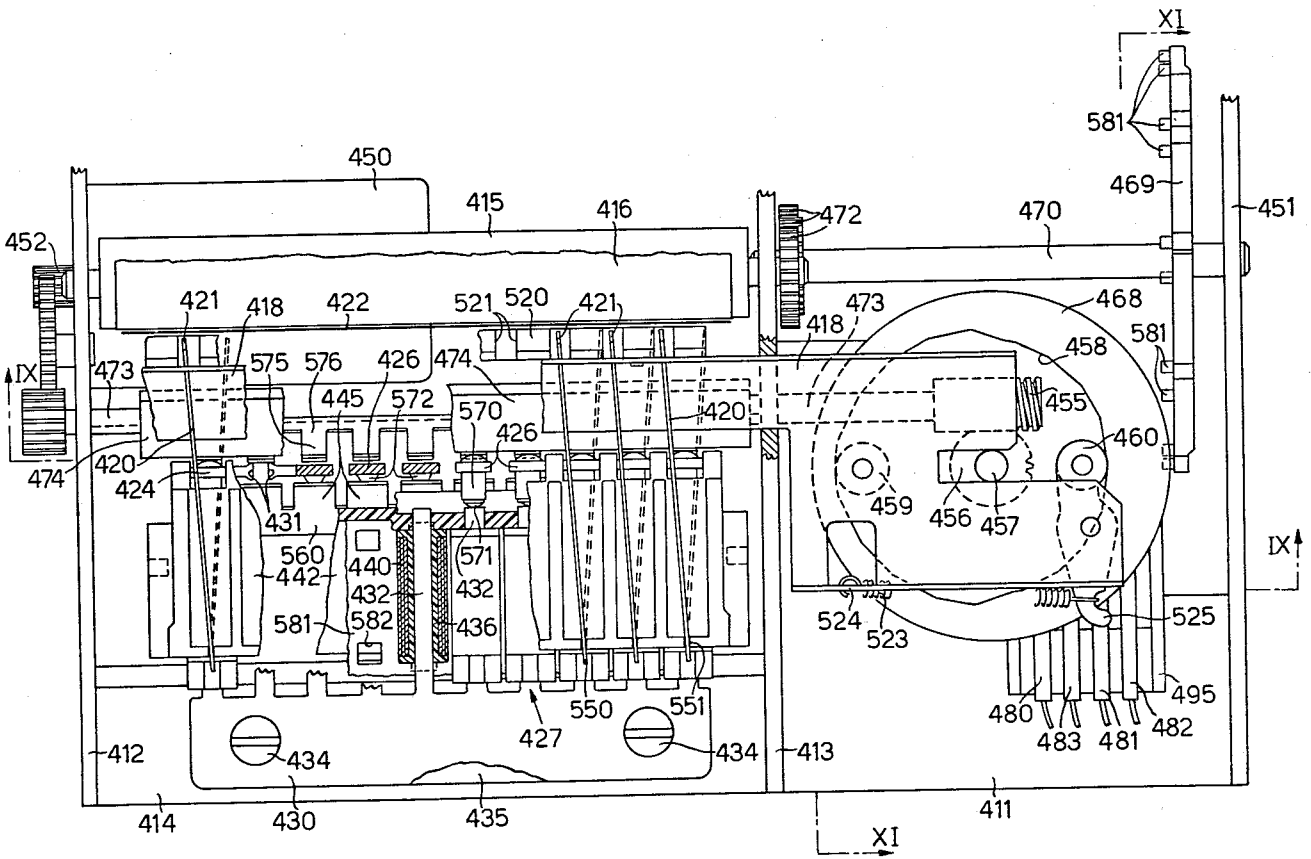
FIG. 8 is a plan view of a modified form of the printing device.
Figure 9:
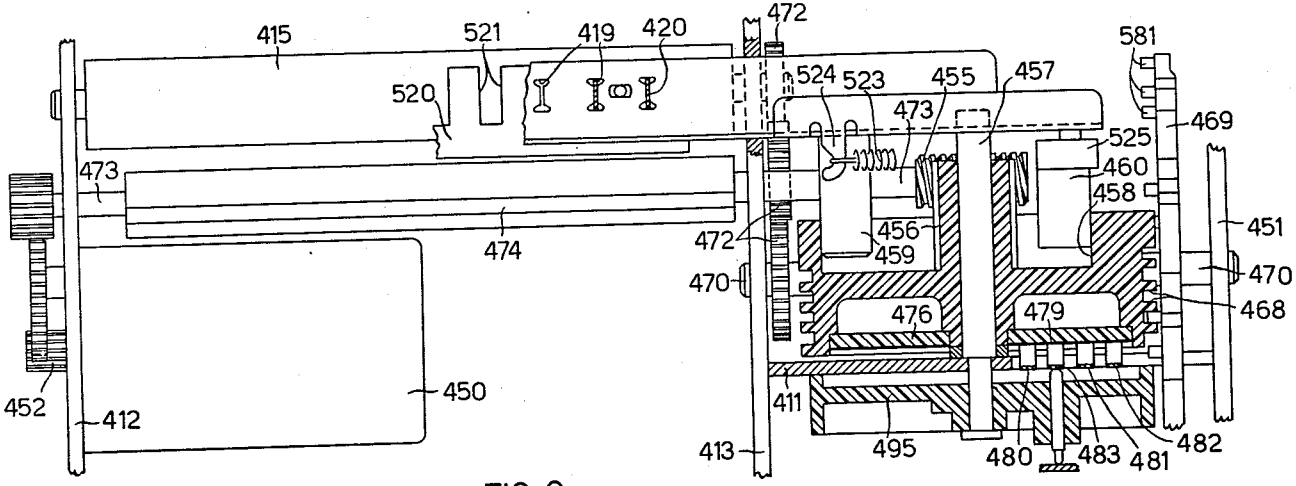
FIG. 9 is a section on the line IX—IX of FIG. 8.
Figure 13:
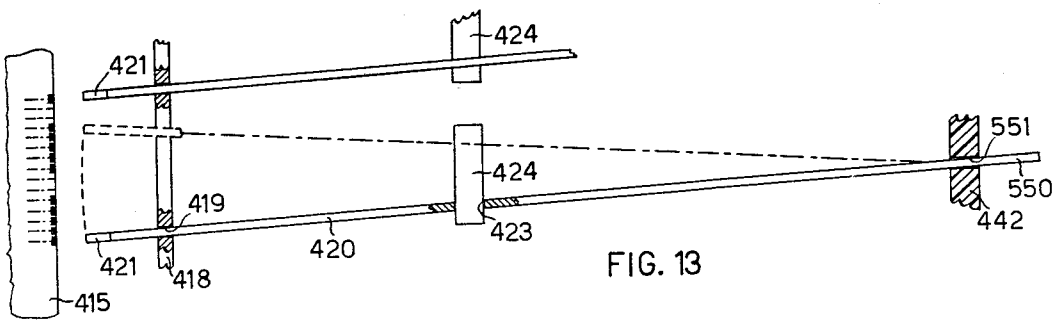
FIG. 13 is a diagram illustrating a detail of the device of FIG. 8 on a larger scale.

Also fast with the gear 56, 456 (FIGS. 3 and 9) is a second worm 68, 468 which has a pitch varying along its circumference and is in mesh with the teeth of a toothed wheel 69, 469 mounted rotatably on a horizontal spindle 70, 470 supported by the side members 13, 413 and 51, 451 (FIGS. 1 and 8). The toothed wheel 69, 469 transmits the motion to the platen 15, 415 via a set of gears 72, 472.

To the worm 55, 455 there is keyed a shaft 73, 473 which is journalled in the side members 12, 412 and 13, 413 and rotates a reloading member 74, 474 comprising a cam which co-operates with the armatures 26, 426 to bring them cyclically back into contact with the corresponding pole pieces 32, 432.

Figure 4:
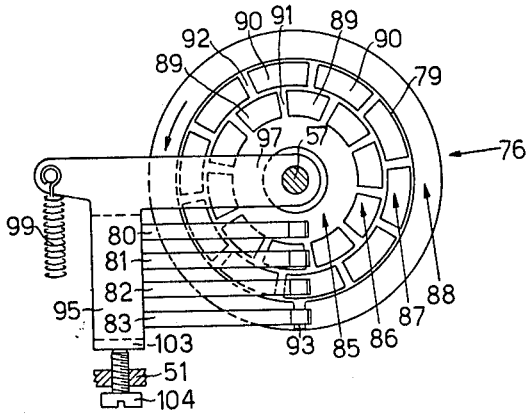
FIG. 4 is a section on the line IV—IV of FIG. 3.
Figure 12:
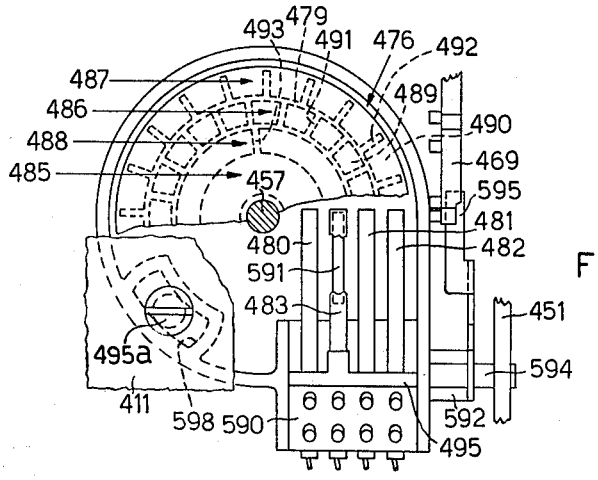
FIG. 12 is a section on the line XII—XII of FIG. 11.

A synchronising disc 76, 476 (FIGS. 4 and 12) is mounted rotatably on the vertical spindle 57, 457 and is fast with the cam 58, 458. The synchronising disc 76, 476 (FIGS. 4 and 12) is constituted by a support of plastics material on one surface of which there is deposited, for example by the printed circuit technique, a layer 79, 479 of a metallic material which is a good electric conductor, such as, for example, gold. The conductive layer defines four circular and concentric tracks 85, 485; 86, 486; 87, 487; 88, 488, with which four sensing tongues or strips 80, 480; 81, 481; 82, 482 and 83, 483, respectively, co-operate. More particularly, the track 85, 485 is entirely metallic, the tracks 86, 486 and 87, 487 have insulating zones 89, 489 and 90, 490, respectively, alternating with conducting zones 91, 491 and 92, 492, respectively, and the track 88, 488 has a single conducting zone 93, 493, while the remaining part is of insulating material. Moreover, the conducting zones 91, 491 and 92, 492 are angularly offset from one another and uniformly distributed around the respective circumferences and are also offset with respect to the conducting zone 93, 493 of the track 88, 488.

The tongue 80, 480 is constantly supplied with an electric reference voltage and the tongues 81, 481; 82, 482 and 83, 483 are adapted to detect the passage of the conducting zones 91, 491; 92, 492 and 93, 493, respectively, to send corresponding electric timing signals SP1, SP2 and SF1 to a sequencing circuit 96 (FIG. 5) of known type, for example of the type described in U.S. Pat. No. 3,951,247. More particularly, the signals SP1 and SP2 which are derived from the tongues 81 and 82, because of the rebounds to which the contact portions of the tongues may be subjected, are composed of a sequence of groups of pulses SP′ (FIG. 6), while the signal SF1 output from the tongue 83 is composed of a sequence of groups of pulses SF′; each group of pulses SF′ is generated every twenty groups of pulses SP′. In order to limit the sliding distances between the contacts, the conducting zones and the adjacent insulating zones are disposed around the periphery of the disc so that their width is the minimum possible compatible with the possibility of processing the signals by means of relatively simple circuits. Since the pulses SP1′ and SP2′ have a relatively short average duration, rebound between the contacts can be recognized as the end of the pulse itself and the resumption of contact with respect to the same conducting zone can be recognised as the beginning of a new pulse SP1′ and SP2′. For the purpose of preventing erroneous interpretations of the pulses SP′ and SF′, the signals SP1, SP2 and SF1 are sent to flip-flops 130, 131 and 132, respectively. The flip-flops 130 and 131 are changed over by the leading edge of each group of pulses SP′ and their outputs are connected to a shaping circuit 142 from which issues the shaped signal SP which is the actual timing signal of the printing dots.

The flip-flop 132, on the other hand, is changed over by the first leading edge of each group of pulses SF′ and has its output connected to a shaping circuit 133 from which issues the shaped signal SF which is the actual timing signal of an elementary printing cycle (20 printing dots to a complete oscillation of the slide 18). The signals SP and SF are sent to a sequencing circuit 96, at which the information relating to the characters which are to be printed arrives on a channel 134 from a calculator 135 to which the printing device may be connected or from a keyboard 136.

The sequencing circuit 96 has outputs 137 connected to the selector electromagnets 27, 427 for selective energisation thereof and comprises a first binary counter 138 and a second binary counter 139 which are adapted to count the timing pulses of the signal SP. More particularly, the counter 138 gives a constant signal as output after five SP' pulses and the counter 139 gives an end-of-cycle signal after eighty SP' pulses, as will be described hereinafter.

The sensing tongues 80, 480; 81, 481; 82, 482 and 83, 483 are supported by a block 95, 495 (FIGS. 4 and 12) of plastics material which is pivoted on the spindle 57, 457 of the fixed frame 11, 411. The block 95 (FIGS. 1 and 4) is constantly pulled towards the side member 51 of the frame 11 by a spring 99 and has a lug 103 bearing against an adjusting screw 104 which can be screwed into, or out of, the side member 51. In this way, by screwing the screw 104 in or out, a turning action of the block 95 with respect to the side member 51 is produced, which advances or retards the picking-up of the synchronising signals by the tongues 81, 82 and 83.

The use of a sliding synchronising disc with the characteristics already described enables a transducer to be obtained which is economic and reliable and which, in contrast to optical or magnetic transducers, does not require high current inputs to be provided for the power supply of the printing device, which is therefore also of limited dimensions for this reason.

In order to bring the reloading member 74, 474, which brings the armatures 26, 426 back cyclically against the corresponding pole pieces 32, 432, into phase with the synchronising disc 76, 476, a leaf spring 106 (shown only in FIG. 1) is fixed to the vertical side member 12, 412. This spring 106 has one end 108 disposed between two flanges 109 and 110 of the shaft 74, 473 and is provided with a through hole 111 through which there extends an adjusting screw 112 screwed into the side member 12, 412. The spring 106 constantly tends to shift the shaft 73, 473 to the left.

By screwing the adjusting screw 112 in or out, axial movements of the shaft 73, 473 (FIGS. 1 and 8) and the worm 55, 455 with respect to the driving shaft 52, 452 are produced. The axial movements of the shaft 73 are possible because of the presence of the coupling 53. These axial movements cause the gear 56, 456 and the synchronising disc 76, 476 to rotate, while the cam 74, 474 is only shifted axially. Moreover, this adjustment can be made with the machine in operation in order if necessary to correct the phase of energisation of the electromagnets 27, 427 and improve the printing cycle, as will be described hereinafter.

The printing device hereinbefore described operates in the following manner. In the inoperative position, the motor 50, 450 is stationary and the slide 18, 418 is stationary at any point of its travel in front of the platen 15, 415. On the switching on of the machine, the counter 138 and 139 of the circuit 96 (FIG. 5) are zeroised in any known manner. By supplying the motor 50, 450 (FIGS. 1 and 8), the worm 55, 455 is set in rotation and consequently causes the cam 58, 458, the worm 68, 468 of varying pitch and the synchronising disc 76, 476 to rotate.

The slide 18, 418 and the bars 20, 420 thus begin to oscillate in front of the sheet of paper 16, 416. After each rotation of the worm 68 through 180°, the platen 15, 415 carries out a small rotation so as to cause the sheet 16, 416 to advance by one elementary step (i.e., the pitch between dots in the matrix) which, in accordance with current standards, is about 0.38 mm.

The sensing tongues 81, 481; 82, 482 and 83, 483 detect the passage of the conducting zones 91, 491; 92, 492 and 93, 493, respectively, sending corresponding electric timing signals SP and SF to the sequencing circuit 96 (FIG. 5) which controls the energisation of the electromagnets 27, 427.

After counting five timing pulses SP', the counter 138 generates a signal enabling printing true and proper. The first pulse SF' which arrives at the sequencing circuit 96 after the enabling signal of the counter 138 gives the start for the printing cycle.

Figure 11:
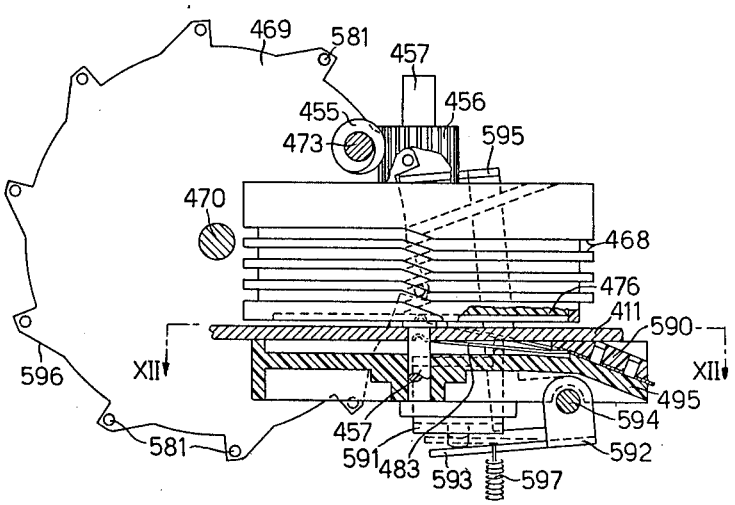
FIG. 11 is a section on the line XI—XI of FIG. 8.

It is to be noted that the synchronising disc 76, 476 (FIGS. 3 and 11), the worm 68, 468 of varying pitch and the cam 58, 458 are offset from one another so that the pulses SF' are generated in coincidence with the advance of the platen 15, 415 and when the slide 18, 418 is located shifted completely to the right (FIGS. 1 and 8). The first row of dots is therefore printed from right to left.

As has been seen, each bar 20, 420 is adapted to print two print characters for each printing line and, therefore, all the 70 dots of the two 7 × 5 matrices must be covered in successive passes, the inked ribbon 22, 422 being impressed only when a predetermined dot is to be printed on the basis of a predetermined code.

Thus, for example, if a bar 20, 420 is to print the numerals one and two (FIG. 7), during the first pass from right to left it imprints the 2nd, 3rd, 4th and 8th dots, while during the second pass, from left to right, it imprints the 12th, 13th, 16th and 20th dots after the paper has been advanced by one elementary step.

Referring only to the device of FIGS. 1 to 7, after the second pass and before the third a second phasing pulse SF' is generated.

After seven passes the bar 20 completes the printing of two characters, but the slide continues to oscillate at least until the completion of the eighth pass. After eighty pulses SP', in fact, the counter 139 generates an end-of-cycle signal which arrests the motor 50, unless an order to print a following line of characters arrives at the sequencing circuit 96 from the calculator 135 or from the keyboard 136.

On sending the end-of-cycle signal after the eightieth pulse SP' from the commencement of the printing, before the motor stops it carries out, owing to inertia, a further small rotation which causes another pulse SF' to be generated and the slide 18 to stop at any point between the ninth and tenth passes. As a rule, the slide 18 stops at least five positions before the completion of the tenth pass. In this way, when the order for another printing cycle is given, a fresh pulse SF' is generated after the counter 138 has generated the enabling signal, having already counted five pulses SP'. By this expedient, while the slide 18 performs three idle passes, line-spacing equal to three elementary advances of the paper 16 is obtained between two successive lines of characters.

The cam 58 is shaped so as to cause the slide 18 to shift at constant speed when the bars 20 are located in correspondence with the printing points and to cause it to accelerate and decelerate during its movement between one character and the other, so that the time taken by the bars 20 to bring themselves from the 5th to the 8th column of the matrices may be equal to the unit time which is taken for the movement between two adjacent columns. Moreover, in this way, the conducting zones 91 and 92 of the synchronising disc 76 are also uniformly distributed along the tracks 86 and 87.

The printing of a dot takes place in the following manner. Referring to the device according to the two embodiments, the armatures 26, 426 are held when inoperative or at rest with a force of about 100 g. against the corresponding pole pieces 32, 432 by the effect of the bias magnetic field created by the strip 35, 435 of magnetic rubber and in opposition to the force of the springs 45, 445 which is equal to about 70 g.

The corresponding selector magnet 27, 427 is now energised by means of a current pulse of about 100 mA for 1 msec. at 18 v. in the coil 40, 440. This creates in the corresponding pole piece 32, 432 a magnetic flux which is opposed to that of the previously existing field, in such manner as to reduce the net magnetic force below the force of the springs 45, 445. The spring 45, 455 can thus urge the armature 26, 426 towards the platen 15, 415, causing it to rotate with respect to its pivoting seat 31, 431. As soon as the armature 26, 426 separates from the pole piece 32, 432, an air gap is formed which further reduces the residual magnetic force and enables the spring 45, 445 to accelerate the armature 26, 426 strongly towards the platen 15, 415.

In this way, the bar 20, 420 is also moved at high speed towards the platen 15, 415 and a dot of substantially square section is imprinted on the sheet of paper 16, 416. Once the printing of the dot has been effected, the cam 74, 474 brings the armature 26, 426 back cyclically into contact with the pole piece 32, 432.

In this cyclic system with mechanical recovery of the armatures, the energisation of the electromagnet 27, 427 which begins substantially at the same instant when the timing pulses are picked up on the synchronising disc 76, 476 must be in phase with the rotation of the cam 74, 474. In order to optimise the printing cycle, this is effected with the machine in operation by screwing the screw 112 into or out of the side member 12, as has been seen hereinbefore.

More precisely, referring to FIG. 14, on a space-time graph *v* of the cam 74, 474 and between the instant when the command of energisation is given to the electromagnets 27, 427 and the instant when the armatures 26, 426 are close to the platen 15, 415, a fixed time *tr* of about 2.3 msec. elapses due to the inductances of the magnetic circuit, the mechanical characteristics of the springs 45, 445 and the inertia of the armatures 26, 426. The command of energisation is therefore given at an instant *to* which is a time *tr* in advance with respect to the instant *t*1 when the cam 74, 474 is beyond the path of the armatures 26, 426 towards the platen 15, 415. Moreover, to enable the bars 20, 420 to imprint a dot correctly on the sheet of paper 16, 416, the recovery of the armatures 26, 426 (instant *t*2) must begin at least after a time *ta* of the order of about 1.5 msec. With times *tr* and *ts* close to the values already given, the nominal printing cycle T becomes about 6.25 msec., which corresponds to a printing speed of two lines per second for the printing system used.

During the operation of the device, the supply conditions of the electric motor 50, 450 may vary and, consequently, the speed of rotation of the shaft 52, 452 may also vary, and therefore that of the cam 74, 474.

The variations in speed of the motor 50, 450, acting on the cycle T and not on the times *tr* and *ta*, alter the conditions of release and recovery of the armatures 26, 426. More particularly, for a lower limit value, corresponding to a curve *v''*, the instant at which the bar 20, 420 touches the platen coincides with the instant *t*1'' at which the cam 74, 474 would tend to arrest the bar. Below this value, the armature 26, 426 would beat against the cam 74, 474 before this has brought itself beyond the path of the armatures 26, 426, thereby preventing the printing of the dot. On the other hand, the speed cannot rise above a value (curve *v'*) such that the instant *t*2' arrives before the time (*tr* + *ta*) has elapsed from the command of energisation of the electromagnets 27, 427, because in this case the armatures 26, 426 would be brought back towards the corresponding pole pieces before the printing of the dot on the sheet of paper 16, 416 has been completed.

In the programming of the nominal speed *v*, account is therefore taken of a safety margin in order to define the range *v'* and *v''* within which the speed will always be satisfactory for obtaining a good printing quality.

On the other hand, the times (*tr* and *ta*), which are optimized for a prototype, may assume values different from one to another in the mass production units. Above all it is desired to have in mass production wide margin of tolerances. Accurate phasing is therefore advisable on each individual unit to take account of the specific characteristics of the unit itself. This can easily be done, with the device in operation, by varying the speed of the motor and thereafter controlling the regularity of the printing in the following manner.

First, the motor 50, 450 is brought to the lower limit speed which, for example, may be 10% lower than the nominal speed, and the screw 112 is operated on so that, with good operation, the picking-up of the timing pulses is advanced to the maximum with respect to the phase of the cam 74, 474, so that the striking occurs at the instant *t*1'', precisely at a time *tr* after the energization of the selector electromagnets 27, 427. Then the motor 50, 450 is brought to the highest speed, which may be, for example, 10% higher than the nominal speed, and it is checked that the instant *t*2' occurs after the time (*tr* + *ta*) has elapsed. It is therefore clear that because of this adjustment or setting-up neither further gradual adjustments in the stationary state on the same unit, nor the use of special test equipment are necessary.

In addition to the phasing already described, the device enables phasing to be effected easily of the instant of energization of the electromagnets 27, 427 with respect to the position of the slide 18, 418 along the printing line, for obtaining a good printing quality with the zig-zag method of printing already described. In fact, if the command to the bars 20, 420 is given when they have not yet reached the nominal printing position or have already gone beyond it, the dots of the rows printed in the passes from right to left will be disposed to the right or to the left, respectively, of the theoretical position, and, conversely, the dots of the rows printed in the passes from left to right will be disposed to the left or to the right, respectively, of the theoretical position, thus giving rise to staggering of the dots in the same column of the matrix.

For this phasing, the adjusting screw 104 is operated on to shift the tongues 80, 480; 81, 481; 82, 482 and 83, 483 with respect to the synchronising disc 76, 476, thus advancing or retarding in this way the picking-up of the timing signals until such time as the dots in the same column are visibly aligned. This adjustment can therefore also be made with the machine in operation, thus permitting an immediate check by the operator on the result of the printing.

The printing device illustrated in FIGS. 8 to 13 has the following modifications with respect to the printing device illustrated in FIGS. 1 to 7.

Each bar 420 (FIGS. 8 and 13) has a front end 550 (remote from the platen) guided in a corresponding slot 551 in the support 442, so that the bars 420, instead of shifting in parallel together with the slide 418, oscillate about their pivoting point constituted by the slot 551, thus describing a circular arc with their printing ends 421. This modification with respect to the device of FIG. 1 enables the dimensions of the upper ends 424 of the armatures 426 which co-operate with the grooves 423 of the bars 420 to be reduced.

In the device of FIG. 1, in fact, the printing tip 21 of each bar 20 is at a distance of 5.1 mm from the adjacent printing tip, since in accordance with current standards with a step equal to 10 characters per inch a print character has a width of about 1.757 mm and the distance between one character and another is about 0.793 mm. The pitch between two adjacent armatures 26 is 5.1 mm. Moreover, since each printing point is at a distance of 0.364 mm from the adjacent point, the useful stroke of each printing tip 21 of the bars 20, and therefore also of the slide 18 in front of the platen 15, is about 4.004 mm and the actual stroke which, for the reasons already described, is greater than the distance between the extreme dots of a row of the dot matrix, is about 4.3 mm. Consequently, in order to be able to co-operate always with the same bar 20, each armature 26 must have its upper end 24 at least 4.6 mm wide. It is moreover expedient that this end 24 of the armatures 26 be wider than the length of the actual stroke of the bars 20. In fact, their width is 4.8 mm. In this way, the nominal clearance between one armature 26 and the adjacent one comes out at 0.3 mm. Consequently, the tolerances, both at the pivoting seats 31 and at the armatures 26, have to be rather fine.

In the device of FIG. 8, on the other hand, while the excursion which the printing tip 421 must perform in front of the platen 415 is still 4.004 mm, it is sufficient that the upper end 424 of each armature 426 be 3.5 mm wide. In this way, the armature 426 being still pitched at intervals of 5.1 mm, the ends 424 have a clearance of 1.6 mm between them and therefore the tolerances may be relaxed.

It is obvious that, in order to reduce the dimensions of the armatures 426 further, they could be placed closer to the pivoting point 551, but, since the rise of the circular arc described by the printing end 421 decreases with the approach of the armature 426 to the end 421, the armatures 426 are disposed at an intermediate point so that the rise may be contained within acceptable and practically negligible levels if these are related to the distance at rest between the printing end 421 and the platen 415. It is obvious that this rise could also be completely nullified by shaping the armature 424 so that it is curved and has a central valley or hollow corresponding to the value of the rise which it is desired to take up.

In order to permit the bars 420 to oscillate, the guides 419 of the slide 418 are slightly wider than the bars 420 themselves. The play which is created between the guide 419 and the bar 420 is, however, negligible when the bars are inclined, whereas it would be excessive when the bars are in the intermediate positions. Since, however, with the printing system adopted, the points intermediate between two characters are never printed on, there is no disadvantage because of this play.

In the modified construction of FIG. 8, instead of the springs 445 being of spiral type, they are constituted by a plurality of leaf springs formed from a single metal plate 560 fixed at the bottom to the support 442 by means of a clamping element 561 of plastics material (FIGS. 8 and 10).

The armatures 426 are also modified with respect to the armatures 26. More particularly, on each of these there is formed a horizontal front projection 570 and a projecting element 572, which is also at the front. The horizontal projection 570 has an end 571 in the form of a spherical cap which normally co-operates with the corresponding pole piece 432. On the projecting elements 572, in turn, there bear the terminal portions of the springs 445.

The use of a spherical surface which contacts the pole piece 432 enables an air gap which is very limited (of the order of 0.02 mm) and constant to be obtained even if the armature 426 is not perfectly aligned, because of the clearance with which it is pivoted, with a negligible air gap, in its seat 431. Moreover, the area of contact being limited, the specific force between the cap 571 and the pole piece 432 becomes very high. This causes any possible foreign particles or traces of lubricant to remain outside the air gap and not affect the reluctance of the magnetic circuit.

The support 442 is also modified with respect to the corresponding support 42. More particularly, in order to receive the ends 571 of the individual armatures 426, a recess 580 is formed in correspondence with each of these. The aim of this recess 580 is to prevent contaminants such as oil, dust or paper fibres, interposing themselves between the armature and the pole piece and thus cause deterioration of the working conditions.

Inside the support 442 and over the entire length thereof there is arranged a non-magnetic metal plate 581 provided with slots 582 in which hooked shanks 583 of each spool 436 are engaged.

As has been seen hereinbefore, an elementary printing cycle T (printing of a dot) has a duration of about 6.25 msec, which corresponds to a frequency of 160 Hz. Therefore, the shaft 73 and the cam 74 rotate under normal conditions at 9,600 revolutions per minute. In order to deaden the noise due to the impact between the cam 74 and the armature 26 during the recovery of the latter, the cam 74 is constituted by an eccentric and, in correspondence with each armature 26, there is arranged slidably in a groove a ring 190 (FIGS. 1 and 2) of plastics material or sufficiently hard rubber. These rings balance the forces on the various armtures 26 and, by rotating in their respective grooves, act so that throughout the period during which the eccentrics 74 maintain the armatures 26 in contact they limit the wear between the parts in reciprocal movement. As a modification, for the purpose of reducing the speed of rotation of the armature reloading member, in particular on account of the problems of balancing that this requires, the cam 474 (FIGS. 8 and 10) has a profile comprising three lobes offset by 120° from one another. Both the speed of rotation of the shaft 473 and that of the motor 450 are thus reduced in the ratio of 3 to 1. Moreover, in order to reduce the overall dimensions of the device, the motor 450 is fixed to the side member 412 below the platen 415. In this case, in order to reduce the noise due to the reloading of the armatures, between the cam 474 and the armatures 426 there are interposed leaf springs 575 formed from a single metal plate 576 which is fixed to a bent lower portion 577 of the frame 411 by means of a clamping element 578 of plastics material. Each upper end 574 of the leaf springs 575 acts on a spherical cap 573 which is formed on the armature 426 opposite the horizontal projection 570, at the rear of the armature.

For the purpose of reducing the time taken to carry out line-spacing between two lines of characters and the wear between the worm and the corresponding pin, the worm 468 (FIGS. 9 and 11) is formed on the periphery of a drum 580 of plastics material and inside which there is formed the profile of the cam 458. Pins 581 of the wheel 469 co-operate with the grooved profile of the worm 468. This profile 468 is formed so that after each 180° of rotation of the drum 580, simultaneously with the reversal of the movement of the slide 418, the platen 415 advances by one elementary step, equal to 0.38 mm, during the first seven passes, and advances by three elementary steps, equal to 1.14 mm, when the slide 418 has completed the seventh pass and is about to perform the eighth (see also FIG. 7). In this way, the sliding for each character between the surface of the worm 468 and the pin 581 is reduced in the ratio of 5 to 1 with respect to the corresponding sliding between the surface of the worm 68 and the teeth of the gear 69. Moreover, the time taken to carry out the line-spacing is substantially equal to that taken for printing a line of dots. To do this, the system for detecting the timing signals is partly modified. More particularly, instead of the pulses SF′ being generated every twenty printing dots, they are generated only at the beginning of a line of characters. In fact, the tongue 483 is normally kept spaced from the synchronising disc 476 by a block 590 arranged on the block 495. The tongue 483 is urged cyclically towards the disc 476 by a slider 591 slidable inside the block 495 and controlled in turn by a bail lever 592. The lever 592 is pivoted on a fixed pin 594 (see also FIG. 12) and has an arm 593 in contact with the slider 591 and an arm 595 in contact with the outer profile 596 of the wheel 469. A spring 597 ensures contact between the lever 592 and the wheel 469.

The outer profile 596 of the wheel 469 is shaped in such manner as to shift the lever 592 cyclically clockwise (FIG. 11) to bring the slider 591 upward and thus bring the tongue 483 against the corresponding track 488 of the disc 476 only at the beginning of each line of characters. As has already been described, the synchronising disc 76 for picking up the twenty timing pulses SP′, which produce the printing of the twenty dots of an elementary printing cycle, has on its tracks 86 and 87 ten conducting zones 91 and 92, respectively, for each track and contact of each of these conducting zones with the corresponding tongues 81 and 82 causes the generation of a timing pulse SP′. Apart from the advantages of easy processing of shaped signals, this also entails reducing to the minimum the dimensions of the disc 76 and the unit sliding effects between the individual tongues and the conducting zones 91 and 92.

The separation of the picking-up of the timing signals on two different members (tongues 81 and 82), however, requires careful precision in the arrangement of the tongues 81 and 82 with respect to the synchronising disc 76. Mutual misalignment thereof, in fact, would lead to a phase difference between the picking-up of the pulses of the track 86 and those of the track 87, and a consequent inequality between the distances between the dots of the matrix. Moreover, this could limit the tolerance in the phasing between the synchronising disc 76 and the recovery member 74 for the armatures 26.

In order to obviate this possible drawback, the synchronising disc 476 presents the following modifications. In each of the tracks 486 and 487 there are twenty conducting zones 491 and 492, so that at each revolution of the disc 476 twenty pulses SP1′ and twenty pulses SP2′ are generated. The signals SP1 and SP2 are sent in one case to the set input and in the other case to the reset input of a single flip-flop which has an output connected directly to the sequencing circuit 96. The pulses SP1′ act in this way as actual timing pulses, while the pulses SP2′, which are out of phase with respect to the pulses SP1′, serve only to reset the pulses SP1′. In this way, the timing pulses SP′, which correspond to the pulses SP1′, are picked up by a single element (tongue 482) and are all equidistant. Moreover, this enables a second flip-flop and a shaping circuit to be saved, compared with the device of FIGS. 1 to 7.

Moreover, as another modification, the block 495 is fixed to the frame 411 by means of a clamping screw **495*a* which engages a slot 598 in the block 495 itself to clamp it removably with respect to the frame 411. By slackening the screw 597, the block 495 can be rotated manually with respect to the frame 411 to advance or retard the picking-up of the timing signals by the tongues 481, 482 and 483** for the purposes seen hereinbefore.

Finally, as a last modification, the profile of the cam 458 is modified with respect to that of the cam 58. In fact, as has been seen, the cam 58 is shaped in such manner as to cause the slide 18 to move at constant speed when the bars 20 are in correspondence with the printing points and cause it to accelerate and decelerate during the movement between one character and the other. In practice, this causes each dot to be printed on the fly, while the slide 18 advances with a continuous motion in front of the sheet of paper 16. According to the modification, on the other hand, the cam 458 is shaped in such manner as to cause the slide 418 to move step by step in front of the platen 415, so that the slide 418 itself is stationary when the bars 420 are actuated.

For the protection of all the bars 420, a cover 599 (FIG. 10) of plastics material is provided, this being arranged above the support 442.

It is moreover to be noted that in order to reduce the cost of the device the armatures 26, 426 are produced by sintering powders of ferromagnetic materials, for example by the method described in the U.S. Pat. No. 3,020,589.

It is obvious that other modifications or additions of parts may be made in the printing devices hereinbefore described without departing from the scope of the claims. For example, both the synchronising disc and the cam which controls the movement of the slide 18, 418 may be keyed directly on the shaft 73, 473 which carries the recovery member for the armatures 26, 426, thus eliminating the coupling between the worm 55, 455 and the gear 56, 456.

The structure of the electromagnets is not limited by the using of particular printing elements. In particular these elements may be flexible wires instead of rigid bars. Moreover, with respect to the synchronizing signals and to the mechanism for the movements between the printing elements and the recording medium, the invention is not limited to the using in impact printers, but it may applied to non-impact printers as in the electrothermal printing unit of the U.S. Pat. No. 3,951,247, which is incorporated herein as reference. In this last case, instead of using as printing elements the bars actuated by electromagnets, it may be used a corresponding plurality of resistors carried by a corresponding support member.

What we claim is:

1. A dot matrix printing device cooperating with an associated recording sheet, comprising:

a platen;

a plurality of parallel, substantially rigid bars disposed in front of said platen;

guide means for moving said bars transversely with respect to said platen along a printing line to define individual dot printing positions thereon;

a plurality of electromagnets associated with said rigid bars, each one of said electromagnets having an actuatable core fixedly mounted with respect to said platen and an armature mounted transversely stationary with respect to said platen;

means for selectively actuating each said core for longitudinally moving each said armature from a rest position to an actuating position; and connecting means for individually connecting each armature of said electromagnets with a corresponding one of said bars, said connecting means allowing said bars to move transversely with respect to the corresponding armatures in response to said transverse movement of said bars and transmitting said longitudinal movement of said armatures to said bars to strike said bars against said platen for the printing of a plurality of dots on the recording sheet.

2. A printing device according to claim 1, wherein said connecting means comprises a slot coupling between each of said bars and the corresponding armature, the width of said armatures being substantially equal to said transverse movement of said bars in front of said platen.

3. A printing device according to claim 1, further comprising a ferromagnetic base which constitutes a common pole piece of said electromagnets, and wherein each one of said cores is substantially parallel to said base, said armature having an end with two arms which are inserted with a clearance into two corresponding holes of said base.

4. A dot matrix printing device according to claim 1, further comprising means for restoring said armatures from said actuating position to said rest position, and wherein said connecting means retracts said bars from said platen as a result of the movement of said armatures from said actuating position to said rest position.

5. A dot printing device according to claim 4, further comprising striking springs for moving said armatures away from said cores of said electromagnets; and wherein each of said electromagnets includes a magnet element in said core for generating a retaining magnetic flux which is sufficient to keep a corresponding armature substantially in contact with said core in opposition to the action of said striking springs but insufficient to overcome said action when said armature is out of contact with said core, and an actuatable winding for generating a flux opposed to said retaining flux so as to allow said striking springs to movesaid armature away from said core for impression of the dot, and wherein said restoring means comprises a reloading member cooperative with said armatures to bring them back into contact with said cores of said electromagnets after the movement thereof away from said cores and against the action of said striking springs.

6. A dot matrix printing device for a printing machine, comprising:

a recording medium supporting platen;

a plurality of substantially rigid bars disposed in front of said platen, each one of said bars comprising a first portion located proximally to said platen and a second portion located distally from said platen;

guide means for moving said first portion of said bars transversely with respect to said platen along a printing line to define individual dot printing positions thereon;

a plurality of electromagnets associated with said rigid bars, each one of said electromagnets having an actuatable core fixedly mounted with respect to said platen and an armature moving with respect to said core;

means for selectively actuating each said core of said electromagnets at each of said printing positions for the movement of each said armature;

means connecting each armature of said electromagnets with a corresponding one of said bars, said connecting means allowing a transverse movement of said bars with respect to said armatures and causing said first portions of said bars to strike against said platen for the printing of dots of characters on the recording medium as a result of said movement of each said armature with respect to each said core of said electromagnets and said transverse movement of said bars with respect to said platen, wherein the width of each armature is substantially equal to said transverse movement of the corresponding bar in front of said platen, wherein each one of said bars has said first portion engaged slidably with said guide means to follow the transverse movement of said guide means and to guide the striking movement of said first portions and said second portion is pivoted slidably in a corresponding guide fixed with respect to said platen, and said connecting means comprises a slot coupling between each of said bars and the corresponding armature, said coupling being located in a third portion of said bar located between said first and said second portion.

7. A dot matrix printing device for a printing machine comprising:

a ferromagnetic base;

a recording medium supporting platen;

a plurality of parallel, substantially rigid bars disposed in front of said platen;

guide means for moving said bars transversely with respect to said platen along a printing line to define individual dot printing positions thereon;

a plurality of electromagnets associated with said rigid bars, said electromagnets each comprising actuatable cores fixedly mounted with respect to said platen and armatures mounted transversely stationary with respect to said platen; said cores having a substantially U-shaped form wherein a first pole piece is common to all electromagnets and is constituted by said ferromagnetic base and a second pole piece is parallel to said common pole piece and is formed by a tongue of a plurality of tongues of a single comb-shaped ferromagnetic plate, and wherein each of said armatures has an end with two arms which are inserted with a clearance into two corresponding holes in said base;

means for selectively actuating said cores of said electromagnets at each of said printing positions for moving said armature with respect to said fixed core; and means connecting each one of said armatures with a corresponding one said bars, said connecting means allowing said transverse movement of said bars with respect to said armatures for causing said bars to strike against said platen for the printing of dots of characters on the recording medium as a result of the movement of said armatures with respect to said cores of said electromagnets and to said transverse movement of said bars with respect to said platen.

8. A dot matrix printing device for a printing machine, comprising:

a ferromagnetic base;

a recording medium supporting platen;

a plurality of parallel, substantially rigid bars disposed in front of said platen;

guide means for moving said bars transversely with respect to said platen along a printing line to define individual dot printing positions thereon;

a plurality of electromagnets associated with said rigid bars, said electromagnets each comprising actuatable cores fixedly mounted with respect to said platen and armatures mounted transversely stationary with respect to said platen; said cores having a substantially U-shaped form wherein a pole piece is common to all said electromagnets and is constituted by said ferromagnetic base and a second pole piece is parallel to said common pole piece and is formed by a tongue of a plurality of tongues of a single comb-shaped ferromagnetic plate, and wherein each of said armatures has an end with two arms which are inserted with a clearance into two corresponding holes in said base;

means for selectively actuating said cores of said electromagnets at each of said printing position for moving said armature with respect to said fixed core;

a plurality of striking springs operatively associated with said armatures for urging said armatures away from said second pole pieces;

a strip of magnetic elastomer interposed between said base and said comb-shaped plate;

clamping means for keeping said magnetic elastomer in contact with said comb-shaped plate and said base, said strip being permanently magnetized for generating a substantially constant magnetic flux in each core opposing the action of said striking springs; and means connecting each one of said armatures with a corresponding one of said bars, said connecting means allowing said transverse movement of said bars with respect to said armatures for causing said bars to strike against said platen for the printing of dots of characters on the recording medium as a result of the movement of said armatures with respect to said cores of said electromagnets and to said transverse movement of said bars with respect to said platen.

9. A dot matrix printing device for a printing machine, comprising:

a recording medium supporting platen;

a plurality of striking elements, each one of said striking elements having an extremity disposed in proximity to said platen;

means for moving said extremity of said striking elements transversely with respect to said platen along a printing line to define individual dot printing positions thereon;

a plurality of striking springs operatively associated with said striking elements for normally urging said extremity of said striking elements toward said platen;

a plurality of electromagnets associated with said striking elements, each one of said electromagnets comprising a magnetic core having two pole pieces; an armature movable with respect to said pole pieces from a rest position in contact with said pole pieces to an actuated position away from said pole pieces; means connecting each one of said armatures with a corresponding one of said striking elements, said striking springs through said striking elements urging said armatures toward said actuated position of said striking elements along the printing line; a magnetic element for generating a retaining flux in said pole pieces sufficient to keep the armature in said rest position in opposition to the action of a corresponding one of said striking springs but insufficient to move said armature from said actuated position to said rest position; a winding actuatable to generate a flux opposite to said retaining flux so as to enable one of said striking springs to move the corresponding one of said armatures from said pole pieces to strike the extremity of the corresponding one of said striking elements against said platen for the printing of dots of characters on the recording medium as a result of the movement of said armature and of the extremity of said striking element; and a reloading member actuatable for engaging said armatures of said electromagnets to return them from said actuated position to said rest position to remove said extremity of said striking elements from said platen after the printing of said dots and against the action of said striking springs.

10. A printing device according to claim 9, wherein said magnetic element comprises a strip of magnetic elastomer permanently magnetized and interposed between said pole pieces.

11. A dot matrix printing device according to claim 9, wherein said reloading member comprises a common member and a plurality of yielding elements each of which are interposed between said common member and a corresponding one of said armatures for reducing the noise due to the reloading of said armatures and improving the contact of said armature with said cores.

12. A printing device according to claim 11, wherein said armatures are aligned parallel to said printing line, wherein said reloading member comprises a cam element mounted on a shaft parallel to said printing line and rotatable for the operation of said cam element, and wherein said yielding means comprises a plurality of leaf springs interposed between said cam element and said armatures for cooperating therewith.

13. A printing device according to claim 9, wherein each of said striking springs comprises a metal tongue formed on a single plate supported parallel to the printing line.

14. A dot matrix printing device for a printing machine, comprising: a base of ferromagnetic material, a recording medium supporting platen; a plurality of striking elements, each one of said elements having an extremity disposed in proximity to said platen; means for moving each said extremity of said striking elements transversely with respect to said platen along a printing line to define individual dot printing positions thereon; striking springs for normally urging each said extremity of said striking elements toward said platen;

a plurality of electromagnets associated with said striking elements, each of said electromagnets comprising a magnetic core of substantially U-shaped form having two pole pieces parallel therebetween, wherein a first one of said pole pieces is constituted by said base and a second one of said pole pieces is formed by a tongue of a plurality of tongues of a single comb-shaped ferromagnetic plate; and an armature mounted on said base and movable with respect to said second pole piece from a rest position in contact with said second pole piece to an actuated position away from said second pole piece;

means connecting each said armature with a corresponding one of said striking elements, in such a manner that said springs normally urge said armatures away from said first pole of pole pieces;

a magnetic element for generating a retaining flux in said pole pieces to keep each said armature in said rest position in opposition to the action of said striking spring;

a winding pulse actuatable to generate a flux opposite to said retaining flux so as to enable said striking spring to move said armature from said rest position to said actuated position to strike said extremity of said striking elements against said platen for the printing of dots of characters on the recording medium as a result of the movement of said armature and of the extremity of said striking elements; and a reloading member cooperative with the armatures of said electromagnets for bringing said armature from said actuated position to said rest position.

15. A printing device according to claim 14, wherein said armatures are aligned parallel to said printing line, wherein said reloading member comprises a cam element mounted on a shaft parallel to the printing line and rotatable for the operation of said cam element, and rings of resilient material mounted on said cam element and operatively associated with said armatures for cooperating therewith.

16. A printing device according to claim 14, wherein said magnetic element comprises a strip of magnetic elastomer permanently magnetized and interposed between said common plate and said comb-shaped plate, and clamping means for keeping said magnetic elastomer in contact with said base and said comb-shaped plate.

17. In a printing machine comprising an actuatable member movable between a rest position and an actuated position; an actuating spring for normally urging said member toward said actuated position; and an electromagnet associated with said actuatable member for causing said spring to move said member from said rest position to said actuated position, the combination comprising:

a magnetic core of said electromagnet including a first and a second pole piece;

an armature of said electromagnet having a first portion disposed in front of said first pole piece and a second portion connected to said second pole piece;

magnetic means for generating a retaining flux in said magnetic core for keeping said armature in a rest position with said first portion arrested against said first pole piece;

a plano-spherical coupling means interposed between said first portion of said armature and first pole piece for causing a minimum gap therebetween when said armature is in said rest position;

connecting means for connecting said actuatable member with said armature in such a manner that said actuating spring normally urges said first portion of said armature away from said first pole piece in opposition to the action of said magnetic means;

means operable for decreasing said retaining flux so as to enable said actuating spring to pivotally move said armature with respect to said second pole piece away from said rest position for causing through said connecting means said actuatable member to move from said rest position toward said actuated position; and reloading means for returning said armature to said rest position.

18. A printing device according to claim 17, wherein said second pole piece comprises a plate with edges, further comprising:

forked coupling means for pivotally supporting said second portion of said armature with respect to said edges of said plate; and a stop element for preventing transverse movement of said armature with respect to said plate during the pivotal movement of said armature.

19. A printing device according to claim 17, wherein said armature is formed by sintering powders of ferromagnetic materials, said coupling means comprising a projection of said first portion having a substantially spherical surface and a corresponding plane surface of said first pole piece.

20. A printing machine according to claim 17, including a plurality of said actuatable members, further comprising:

a recording medium supporting platen;

said actuatable members each having an extremity disposed in proximity of said platen;

guide means for moving each said extremity of said members transversely with respect to said platen along a printing line to define individual dot printing positions thereon; and control means for selectively actuating said operable means at each of said printing positions for causing the movement of said armature from said rest position to said actuated position, said means causing through said connecting means the extremity of said members to strike against said platen for the printing of dots of characters on the recording medium as a result of the pivotal movement of said armature with respect to said first pole piece and the transverse movement of said members with respect to said platen.

21. A printing device according to claim 17, further comprising a support of non-magnetic material having recesses for protecting said plano-spherical coupling means and wherein each one of said actuating spring comprises a metal tongue formed on a single plate mounted on said support of non-magnetic material.

22. In a printing machine comprising an actuatable member movable between a rest position and an actuated position; an actuating spring urging said member from said rest to said actuated position; and an electromagnet associated with said actuatable member, the combination comprising:

a magnetic core of said electromagnet including a pair of pole pieces;

an armature of said electromagnet formed by sintering powders of ferromagnetic materials and movable with respect to said pole pieces and connected with said actuatable member in such a manner that said actuating spring normally urges said armature away from said pole pieces;

a magnetic means for generating a retaining flux in said pole pieces to keep said armature in a rest position in opposition to the action of said spring;

means operable for decreasing said retaining flux so as to enable said actuating spring to move said armature away from said rest position for positioning said actuatable member in said actuated position;

reloading means for returning said armature in said rest position;

means connecting said armature with respect to said pole pieces for a minimum gap therebetween when said armature is in said rest position, said connecting means comprising a planospherical coupling means causing a first portion of said armature to bear against a first pole of said pole pieces, said coupling means comprising a projection of said first portion of said armature having a substantially spherical surface and a corresponding plane surface of said first pole piece; a forked coupling for pivotally supporting said armature with respect to said pole pieces and for causing a second portion of said armature to bear against a second end of said pole pieces; and a stop element for preventing transverse movement of said armature with respect to said pole pieces during the pivotal movement of said armature and a support of non-magnetic material provided with recesses for protecting the coupling between the armature and said pole pieces.

23. In a dot matrix printing device for a printing machine comprising a recording medium supporting platen; a plurality of striking elements disposed in proximity to said platen; means for moving said striking elements transversely with respect to said platen along a printing line to define individual dot printing positions thereon; striking springs for urging said striking elements toward said platen; a plurality of electromagnets associated with said striking elements, each one of said electromagnets including a magnetic core and an armature movable with respect to said core; means connecting said armature with a corresponding one of said striking elements in such a manner that said springs normally urge said armatures away from said cores, and magnetic means for generating a retaining flux in said cores to keep said armatures in a rest position in contact with said cores in opposition to the action of said springs; and a winding associated with each said core and actuatable to generate a flux opposite to said retaining flux so as to enable said springs to move said armatures from said rest position to an actuated position away from said core for striking said striking elements against said platen for the printing of dots of characters, the combination comprising:

synchronizing means for generating a synchronizing signal responsive to the dot printing positions of said striking elements along the printing line;

a current generator means responsive to said synchronizing signals for selectively actuating said windings of said electromagnets to effect a striking movement of said striking elements against said platen;

a reloading cam operatively associated with said armatures for returning said armatures to said rest position in contact with said cores after the striking of said striking elements, said reloading cam returning said armatures after a substantially fixed time delay from the generation of said synchronizing signals; and means for adjusting the angular position of said reloading cam with respect to said synchronizing means for varying said substantially fixed time delay between the beginning of movement of said armatures from said rest position to said actuated position upon actuation of said windings and the return thereof for control of the striking of said striking elements against said platen.

24. Dot printing device for calculating, accounting machines, typewriters and like office machines, wherein the dots are imprinted in a matrix of row and columns, comprising a paper support; a slide; feeding means for moving said slide in front of the paper support in both directions for defining the rows of the matrix in successive passes from right to left and from left to right; advancing means connected with said slide for advancing the paper support an elementary step after the completion of each said pass; a plurality of printing elements mounted in said slide; a plurality of actuators connected to said printing elements; a synchronizing disc connected to said slide and carrying a plurality of synchronizing elements associated with each column of the matrix; sensing elements disposed in front of the synchronizing elements and connected to said actuators of the printing elements; and a regulating means connected with said sensing elements for regulating the position of said sensing elements with respect to said synchronizing disc for control of the alignment of the columns of printed dots of each matrix.

25. A dot printing device according to claim 24, wherein each printing element prints at least two consecutive characters of a line of print which are separated by a corresponding space, and wherein said feeding means comprises a cam connected to said slide, said cam comprising parts which accelerate said slide in the space separating two adjacent characters, so that the time for passing through said space is substantially equal to the time taken by said slide to shift between two adjacent columns of the matrix, whereby said synchronizing elements are equidistant therebetween along said synchronizing disc.

26. A dot printing device according to claim 24, wherein said synchronizing disc carries a plurality of insulating zones alternated with electrically conductive zones disposed on two concentric tracks, wherein said sensing elements comprise two contacts for contacting said conductive zones to alternately generate signals defining dot printing positions of said printing positions of said printing elements with respect to said paper support, and further comprising two storing devices, each having an output terminal, a first input terminal connected to one of said contacts and a second input terminal connected to the other of said contacts, said output terminal being set upon generation of said signals on said first input terminal and being reset by the signals on said second input terminal; and a pulse generating circuit connected to both the output terminals of said two storing devices for generating a pulse signal at each set of the output terminal of said two storing devices.

* * * * *